United States Patent [19]

Johnson

[11] Patent Number: 4,722,258

[45] Date of Patent: Feb. 2, 1988

[54] LOG SAWING APPARATUS

[76] Inventor: Calvin S. Johnson, Rte. 1, Box 254, Union Grove, N.C. 28689

[21] Appl. No.: 237,739

[22] Filed: Feb. 24, 1981

[51] Int. Cl.[4] ..... B27B 17/08

[52] U.S. Cl. ..... 83/72; 83/795; 83/796; 83/801; 83/639

[58] Field of Search ..... 83/795, 796, 797, 639, 83/801, 794, 800, 574, 928, 72

[56] References Cited

U.S. PATENT DOCUMENTS 2,759,501 8/1956 Kliever ..... 83/801 X
4,245,535 1/1981 Lockwood et al. ..... 83/798

FOREIGN PATENT DOCUMENTS 237476 6/1969 U.S.S.R. ..... 83/795

*Primary Examiner*—Donald R. Schran
*Attorney, Agent, or Firm*—Shefte, Pinckney & Sawyer

[57] ABSTRACT

A hydraulically powered treelength log sawing apparatus has a log support lined with teeth opposing the outwardly-directed sawing force generated by its drive-shaft-pivoted chainsaw. The chainsaw is driven by a hydraulic motor whose fluid exhaust flows through a conduit to an adjustable restriction which creates a backpressure in the fluid in the conduit. The magnitude of the backpressure is directly related to the speed of the motor and the saw, and the backpressure is directed to a hydraulic cylinder which forces the chainsaw into sawing engagement with logs on the support, thereby prevent stalling of the saw and in general causing the saw speed and engagement force respectively to be self-compensating and requiring no attention from the operator during sawing. An arrangement of automatic valves and bypass conduits removes the power from the motor and reverses the hydraulic cylinder to disengage the saw from the logs upon simple reversal of the inlet and outlet or exhaust connections between the motor and cylinder and the hydraulic power supply, as by shifting a four-way valve which passes the pressurized and exhaust fluid flows to the apparatus.

6 Claims, 5 Drawing Figures

LOG SAWING APPARATUS

BACKGROUND OF THE INVENTION

Log buckers or treelength log cutting apparatus known in the prior art have generally used some type of knuckleboom loader to gather, place, and hold logs or trees in suitable supports for cut off by radial or chain saws mounted on the apparatus.

Hydraulic pressure under manual control has conventionally been used to force such a saw into sawing engagement with the logs, and the saw has frequently stalled because the resistance of the logs to sawing may vary suddenly for reasons of the species, rotten spots or knots in logs, shifting of the logs as they are sawed, and transition of the saw through a stack of logs whereby one log may be engaged at first, then two or more, and finally none as the sawing is completed. Constant and skillful attention by the operator is required to continually feather a control valve to prevent stalling the saw and to keep the saw cutting efficiently at near full sawing capacity.

The present invention provides automatic compensation for the saw engaging hydraulic pressure according to the varying log resistance to sawing, so that the saw can automatically cut with maximum suitable power and without stalling while requiring a minimum of attention and skill from the operator; i.e., the operator merely operates an electrical switch or fully operates a control valve to saw, no feathering required.

In the past, saws of the type to which the present invention is applicable have been conventionally desirably powered from the hydraulic power unit of the knuckleboom loader or some other hydraulic power unit; and especially when the loader is of the "full-swing", or unlimited rotation type where the operator is located on the swinging, rotating portion of the loader, it is convenient to run only two hydraulic hoses from the operator's position through the hydraulic swivel joint connections of the loader to the saw for powering and controlling both sawing and saw engagement.

The present invention provides for powering the saw and engaging it with the logs when one of the hoses is connected to the pressurized fluid and the other to the return line of the power unit, and for automatically cutting off power from the saw and disengaging it from the logs when the hose connections to the power unit are reversed, as by manual operation of a valve at the operator's position. Two hose power and control of the saw is also advantageous for "limited swing" loaders where a switch at the operator's position can control a solenoid valve for reversing the hose connections as aforesaid. In neutral position of the valve, the two hoses to the saw are blocked off, and the pressurized fluid passes freely on to perform other loader functions as selected by operation of other valves connected to the first-mentioned valve.

The sawing force exerted by the teeth of a saw of this general type is conventionally applied in a direction toward the actuating mechanism and point of attachment of the saw to the apparatus, similarly to hand held chainsaw practice, where safety requires it. When the logs shift during cutting with such an arrangement, as frequently occurs, the tendency is for the logs to shift toward the attachment point and often somewhat sideways of the cutting edge of the saw, thereby pinching, wedging, or binding the saw toward its attachment point. Such sideways jamming toward the attachment point tends to be self-wedging, may stall the saw, and can exert great sideways force on the saw with severe damage resulting at the attachment point, in the linkages of a circular saw, or particularly by bending the guide bar of a chain saw close to its attachment point. Not only are parts likely to be bent out of shape, but the saw may become wedged and jammed into the logs so that production must be stopped while the jam is cleared, and it may even be necessary to use hand axes to relieve the jam. Also, cutting toward the mechanism and attachment point means that the resulting sawdust (frequently including sand and dirt) is thrown on and into the working parts with bad effects such as premature wear, corrosion, and labor required for cleanup.

The present invention arranges the apparatus to direct the sawing force away from the mechanism and attachment point so that any log shifting occurs in an outward direction away therefrom, and there is no self-wedging tendency. Thereby, the possibility of saw damage is lessened, as is the skill level required of the operator. Sawdust, sand, and dirt from the sawing will be thrown away from the saw mechanism with resultant benefits as to cleanliness, corrosion, and wear.

While generally symmetrical lugs have been used on the inner surfaces of the log supports to discourage log shifting, the present invention provides lugs of sawtooth profile with the points oriented to oppose the sawing force which tends to shift the logs.

The distinct advantages provided by the present invention are finding a ready market in the logging trade.

SUMMARY OF THE INVENTION

Briefly described, the present invention provides power saw apparatus for sawing logs to length including a support for supporting logs for sawing, a power operated saw disposed for sawing logs supported on the support, a motor connected to the saw for driving it, operating means for imparting relative movement between the saw and the support for forcing the saw and the logs into sawing engagement for sawing through the logs, and a power circuit for supplying power to the motor and the operating means, the power circuit having means for applying power to the motor for operation thereof to drive the saw and to the operating means for causing the operating means to impose a sawing engagement force between the saw and the logs with the force exerted being directly related to the operational speed of the motor whereby an increase in resistance of the logs to sawing causes a reduction in the saw operating speed which results in a decrease in the sawing engagement force and a decrease in the feed of the saw for sawing through the logs thereby preventing stalling of the saw during sawing engagement and a drop in resistance of the logs to saw results in an increase in the saw operating speed and the sawing engagement force thereby causing an increase in the feed of the saw for sawing through the logs, the operating characteristics of the saw, motor, operating means, and power circuit being correlated for causing automatic compensation between the saw speed and the sawing engagement force for preventing stalling during high resistance of the logs to sawing while causing the aforesaid increase in the saw feed for greater sawing production during low resistance of the logs to sawing.

The apparatus of the present invention may be hydraulically powered for driving the motor and biasing the operating means, and may have a hydraulic pump and first conduit means connected to the pump and the motor for supplying hydraulic fluid under pressure to the motor to flow therethrough for the aforesaid operation thereof to drive the saw, a second conduit means connected to the pump and the motor for return flow of the fluid from the motor to the pump, and means for causing hydraulic fluid to be supplied to the hydraulically biased operating means at pressures of magnitudes which are related to the operational speed of the motor and the sawing forces generated by the saw against the resistance of the logs being sawed for causing the operating means to impose the aforesaid sawing engagement force between the saw and the logs.

Preferably, the embodiment of the present invention provides for the magnitudes of the pressures supplied to the operating means to be directly related to the operational speed of the motor and inversely related to the sawing forces, and the means for causing the hydraulic fluid to be supplied to the operating means at pressures of magnitudes so related includes a restriction of the second conduit means between the motor and the pump for causing such pressures in the fluid in the second conduit means between the motor and the restriction during the aforesaid return flow, and also includes third conduit means connected to the operating means and the return flow second conduit means at a location therein for supplying a portion of the fluid under the aforesaid pressures to the operating means for causing the operating means to impose the aforesaid sawing engagement force.

Preferably, the embodiment also includes means for stopping the drive of the saw and for reversing the operating means to impart relative movement between the saw and the support for disengaging the saw and the logs, the operating means having a forcing portion for causing the forcing movement upon supply of pressurized fluid to the forcing portion and a reversing portion for causing the disengaging movement upon supply of pressurized fluid to the reversing portion, the third conduit being connected to the forcing portion, and the means for stopping and reversing including means for causing reversal of the connections between the pump and the motor and the first and second conduit means for causing the hydraulic fluid under pressure to be supplied to the return flow second conduit means, means located in the return flow second conduit means for automatically blocking flow of pressurized fluid to the motor and the forcing means upon the aforesaid reversal of connections, means located in the third conduit means for automatically blocking backflow of fluid from the forcing means to the motor upon the aforesaid reversal of connections, and means located in the return flow second conduit means between the reversal means and the means for automatically blocking flow of pressurized fluid to the forcing means for allowing flow of pressurized fluid to the reversing portion, whereby the reversal of the supply and return flow connections causes such stopping and reversing.

The preferred embodiment of the present invention further includes first blocking means located in the return flow second conduit means between the reversal means and the restriction for blocking reverse flow of the hydraulic fluid under pressure beyond the blocking means toward the restriction and the motor, second blocking means located in the third conduit means for blocking reverse flow therethrough from the operating means, fourth conduit means connected between the first conduit means and the third conduit means with the fourth conduit means being connected to the first conduit means at a location between the reversal means and the motor and to the third conduit means at a location between the second blocking means and the operating means with the fourth conduit means having third blocking means located therein for blocking flow therein from the first conduit means to the third conduit means, and fifth conduit means connected between the reversing portion of the operating means and a location on the second conduit means between the reversal means and the first blocking means for supplying pressurized fluid to the reversing portion upon the aforesaid reversal of connections between the pump and the motor and the first and second conduit means.

Also, the embodiment preferably includes drive means for driving connecting the motor to the saw for imposing the aforesaid sawing forces in a direction outwardly of the apparatus, thereby tending to throw the resulting sawdust away from the apparatus. The preferred embodiment of the present invention provides that the saw is a chain saw having a drive sprocket for its chain and a drive shaft on which the sprocket is mounting for rotation therewith, the shaft being connected to the motor and the chain saw having a chain guide bar mounted on the shaft for pivoting motion thereabout for said sawing engagement, the shaft being mounted on the log support for rotation, and the drive sprocket being rotated in a direction such that the sawing force of the chain is directed away from the sprocket during the aforesaid sawing engagement, thereby throwing the resulting sawdust away from the sprocket.

In addition, the aforesaid log support preferably has lugs thereon with log-engaging portions thereof for resisting shifting of the logs supported thereon, the log-engaging portions being sawtooth-shaped and pointed in a direction opposed to the sawing force for resisting of the logs by the sawing force generated by the saw during sawing engagement.

DESCRIPTION OF THE PREFERRED EMBODIMENTS

Figure 1:
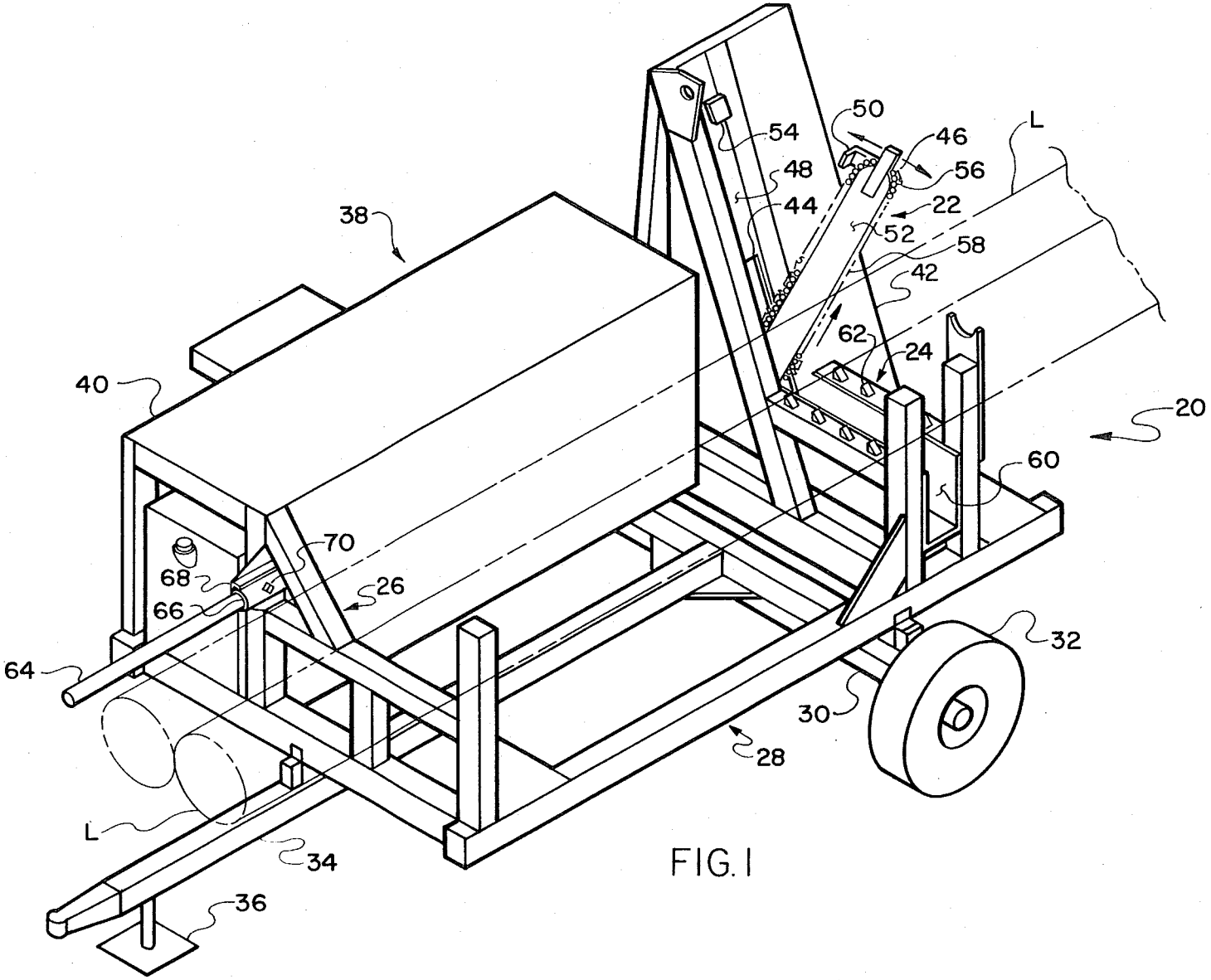
FIG. 1 is an overall perspective view of a treelength log sawing apparatus according to the present invention.

FIG. 1 shows a log bucker or treelength log cutting or sawing apparatus 20 having a chainsaw 22 located thereon for crosscuttting logs, treelength logs, or tree trunks stacked in log supports 24 and 26 which are located on, attached to, and part of the frame 28 of the log bucker 20. The frame 28 is supported above the ground by an axle shaft 30 attached thereto and wheels 32 (one not shown) mounted on the axle 30. A trailer tongue 34, part of the frame 28, is supported by a steady rest 36 provided for placement thereunder to position the frame 28 for holding the logs L in a generally horizontal position. A conventional hydraulic power unit 38 (preferably driven by an internal combustion engine) is also carried on the frame 28, largely concealed under a cover 40, but is an optional feature in the apparatus and forms no novel part of the present invention. The chain saw 22 extends from within an angular guard portion 42 of the support 24 through a slot or opening 44 therein. The chainsaw 22 is pivoted at its drive end (as explained hereinafter) for up and down motion at its extending end 46 as indicated by the arrows shown adjacent thereto. The guard 42 has a recessed portion 48 for reception of the saw 22 at least partially thereinto upon such upward pivoting motion for removing the chainsaw 22 from harm's way during transport and especially while logs L are loaded onto log supports 24 and 26. A stop 50 connected to the guide bar 52 of the chainsaw 22 adjacent the extending end 46 thereof and extending thereabove strikes a reinforcing plate 54 provided in the bottom of the recessed portion 48 upon pivoting retraction of the chainsaw 22 fully upwardly into the recessed portion 48.

The chain 56 of the chainsaw 22 is trained conventionally around the guide bar 52, but is powered to move, unconventionally, toward the extending end 46 along its lower reach 58 as indicated by the arrow shown adjacent thereto. Thus, the cutting or sawing force of the chainsaw 22 when lowered into sawing engagement with the logs L is directed outwardly toward the extending end 46 and away from its drive end where it is pivoted or attached to the frame 28 behind the angular guard 42. The sawdust created during such sawing engagement is therefore thrown outwardly of the apparatus and away from it either into the sawdust trough 60 under the log support 24 or out onto the ground adjacent the near side of the apparatus 20 as shown in FIG. 1.

The logs L have a tendency to shift outwardly away from the angular guard portion 42 under the outwardly directed sawing force, and are at least partially, and beneficially, restrained from that tendency by the sawtooth shaped lugs 62 provided in the bottom of the log support 24 with their teeth oriented or pointed in a direction opposed to the sawing force of the chainsaw 22 for resisting such shifting. The tendency to shift the logs L outwardly rather than inwardly is also beneficial when the logs do shift (as is inevitable from time to time) even though they are normally held in place on the supports 24 and 26 by the grapple tongs or jaws of the knuckleboom loader (not shown) which is normally used in conjunction with the apparatus 20 to sort, pick up, and position logs L on the supports 24 and 26. The beneficial effect lies in the fact that logs L shifting outwardly have much less tendency to wedge, pinch, or bind the saw by skewing or sidewise motion relative to the saw than would logs shifting inwardly as in conventional sawing, where the logs L would be drawn against the angular guard 42 by conventionally directed sawing forces, tending to be self-wedging with the guide bar 52 by virtue of any sidewise motion to the point of jamming and stopping the saw chain 56 and with danger of bending the guide bar 52 and getting the chain 56 out of its track therein.

A gage rod 64 is adjustably inserted in the bore 66 of a bracket 68 on the frame 28 and may be locked in any desired position by a setscrew 70 extending into the bore 68. The knuckleboom loader operator uses the extending end of the rod 64 to gage the position in which the places the ends of the logs or trees L so that they can be cut off in equal length segments.

Figure 2:
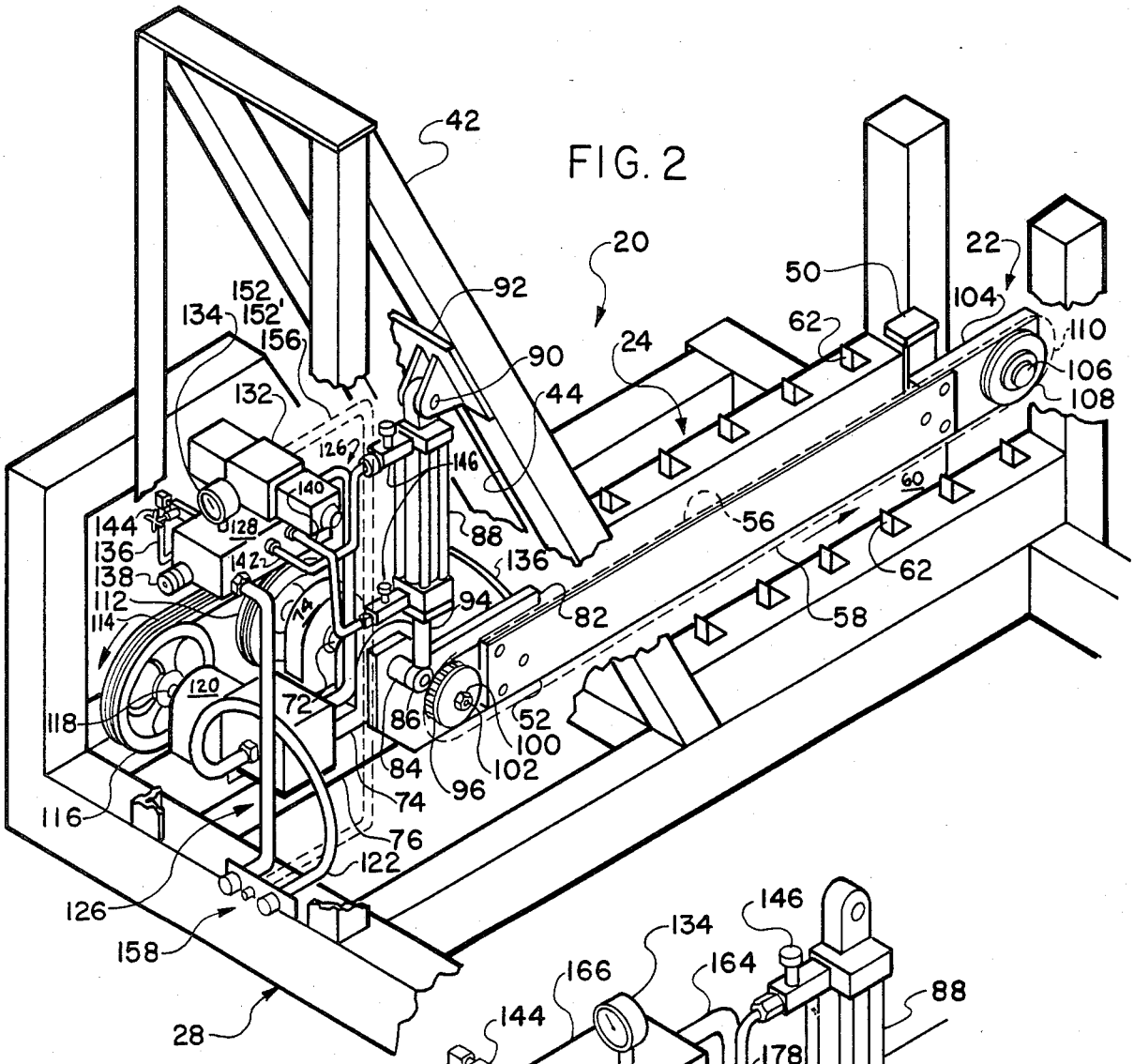
FIG. 2 is a partially broken-away right rear perspective view of one embodiment of the hydraulic and mechanical aspects of the sawing portion of the apparatus of FIG. 1.
Figure 4:
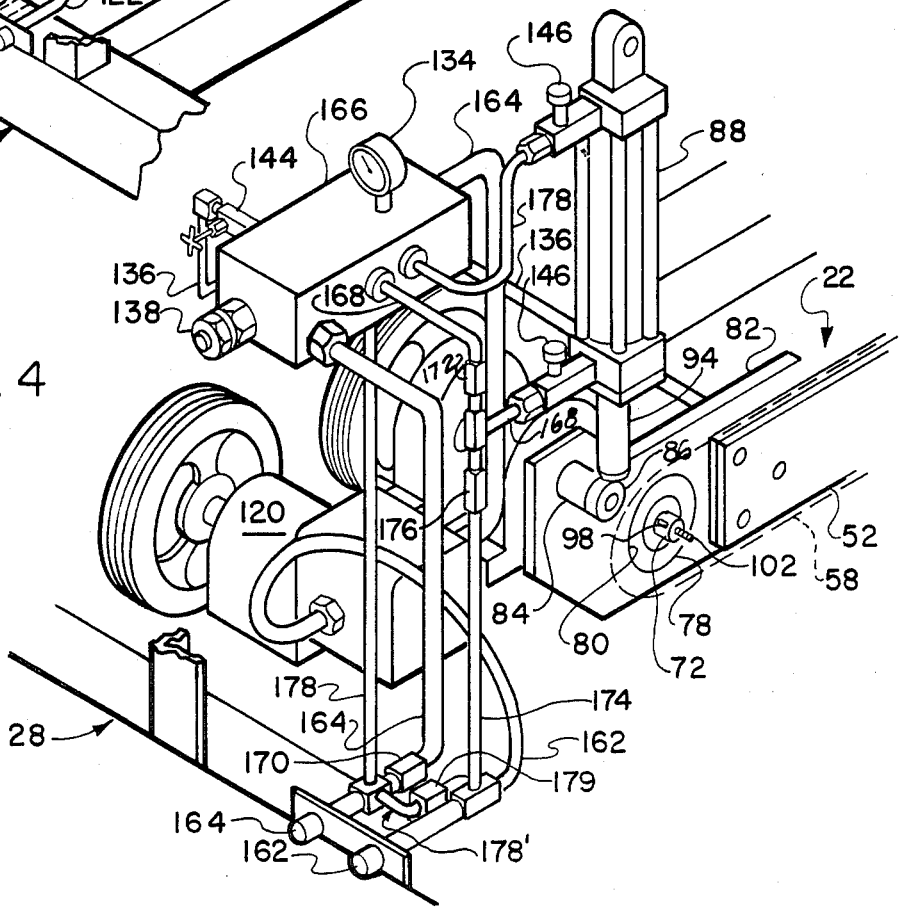
FIG. 4 is a perspective view similar to FIG. 2 illustrating an alternative embodiment of the hydraulic apparatus of the present invention.

Details of the mounting, driving, and sawing engagement portions of the apparatus 20 are shown in FIGS. 2 and 4, where portions of the angular guard 42 and the frame 28 are broken away to disclose the chainsaw 22 pivoted fully downwardly about its driveshaft 72 into the trough 60 after sawing through a log or logs L. The shaft 72 is mounted for rotation in ball bearing pillowblocks 74 which are in turn mounted on a crossbar 76 of the frame 28. A ballbearing 78 has its inner race mounted on the outwardly extending end of the shaft 72 and its outer race mounted in a bore 80 of a bellcrank bracket 82 as shown in FIG. 4. The rightwardly extending arm of the bracket 82 has mounted thereon the guidebar 52 of the chainsaw 22 and the leftwardly extending arm thereof has mounted thereon a stud 84 to which is pivotably attached the rod end 86 of a hydraulic cylinder 88. The blind end of the cylinder 88 is pivotably connected by a pin 90 to a clevis bracket 92 which in turn is mounted on the angular guard portion 42 of the frame 28. Thus, extension of the piston rod 94 of the cylinder 88 will cause the bracket 82 to pivot counterclockwise on the ballbearing 78 about the driveshaft 72, thereby causing the guidebar 52 and the whole chainsaw 22 to pivot upwardly about the driveshaft 72, and the cylinder 88 forms a hydraulically biased operating means for imparting relative movement between the chainsaw 22 and the log supports 24 and 26.

A drive sprocket 96 for the chain 56 is also mounted on the extending end of the driveshaft 72, beyond the ballbearing 78, and is locked to the shaft 72 by a key 98 (as shown in FIG. 4) mounted therein and by a retaining nut 100 screwed onto a threaded extension 102 of the shaft 72. A bearing and stop bracket 104 is mounted at the extending end of the guidebar 52 and carries the stop 50 and a bearing stud 106 on which a ballbearing idler roller 108 is mounted for free rotation to carry the outer reach 110 of the chain 56. Such an idler roller is desirable because the novel running direction of the chain 56 in the present invention causes the aforesaid outer reach 110 to carry all the sawing force of the chain 56. The chain 56 therefore could not ride satisfactorily in a groove around the extending end of the guide bar 52 (as is conventional in ordinary chain saws where the sawing force is directed toward the drive sprocket and the sawing force is carried by the chain only between the drive sprocket and the log being sawed, leaving the outer reach of the chain relatively slack around the extending end or nose of the guide bar).

The novel mounting of the bellcrank bracket 82 for rotation on the driveshaft 72 is unique in allowing the chainsaw 22 to pivot about the shaft 72 for sawing engagement as well as allowing the shaft 72 to rotate at high speed within the chainsaw 22 to drive the sprocket 96 and thereby the chain 56 for sawing action.

As shown in FIG. 2, the far end of the driveshaft 72 extends beyond the farthermost pillowblock 74 and has mounted thereon for rotation therewith a first V-belt pulley 112 which is driven through the V-belts 114 by a second V-belt pulley 116 which is mounted on the shaft 118 of a conventional positive displacement hydraulic motor 120 for rotation therewith. The motor 120 is driven in counterclockwise direction as seen in FIG. 2 by pressurized hydraulic fluid flowing thereto through a first conduit means 122 connected to the motor 120 and to a conventional hydraulic pump 124 (not shown in FIG. 2, but shown in FIG. 3 where both hydraulic power and utilization circuits are shown schematically). The first conduit means 122 includes a passage through the right side of the spool of a solenoid valve 125 when the valve 125 is actuated for operation of the chainsaw 22 (the valve 125 is not shown in FIG. 2, but rather in the schematic FIG. 3, where it is shown in unactuated condition).

The pump 124 may be contained in the hydraulic power unit 38 on the frame 28 of the apparatus 20 as shown in FIG. 1, or it may be in a separate power unit such as that of the knuckleboom loader (not shown) normally used with the apparatus 20 of the present invention, in which case the power unit 38 may be omitted from the apparatus 20. The aforesaid pressurized hydraulic fluid, upon actuation of the valve 125 and after driving the motor 120, flows therefrom through a second conduit means 126 including a restrictor block 128 and a conventional hydraulic fluid reservoir 130 for return flow to the pump 124.

Figure 3:
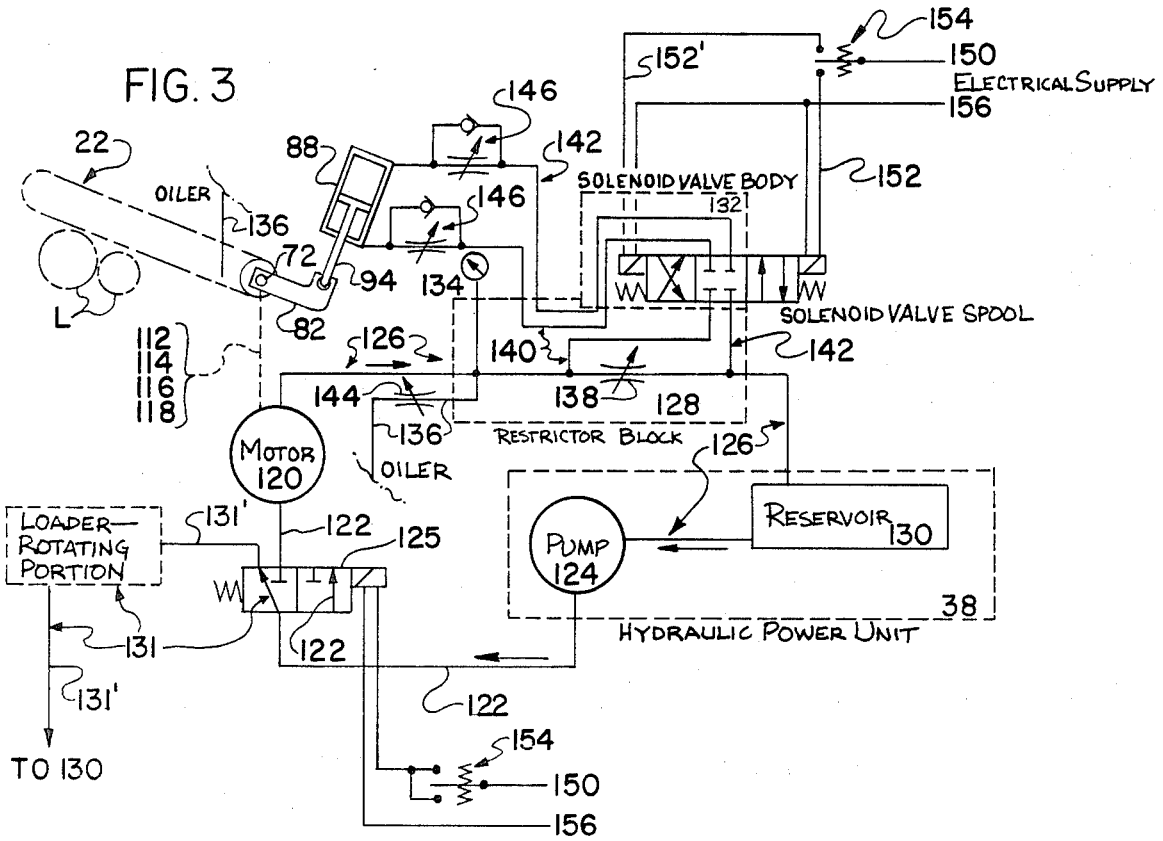
FIG. 3 is a schematic diagram of the hydraulic and mechanical apparatus shown in FIG. 2.

Utilization means 131 for the rotating portion of the knuckleboom loader, as indicated schematically in FIG. 3, may typically be operated selectively and alternatively to the aforesaid operation of the chainsaw 22 when the valve 125 is in its unactuated condition as shown in FIG. 3 and fluid flow to the motor 120 is blocked thereby. The utilization means 131 includes a passage through the left side of the spool of the solenoid valve 125 (which passage is connected to the portion of the conduit means 122 located between the pump 124 and the valve 125 when the valve 125 is in its unactuated condition); various hydraulic valves and other equipment indicated schematically by, but not shown in, the broken line LOADER--ROTATING PORTION block of the utilization means 131; and conduit means 131' connecting the valve 125 to the LOADER--ROTATING PORTION block and running therefrom back to the reservoir 130. The LOADER--ROTATING PORTION includes the apparatus for rotating the boom and tongs of the loader, which are normally not operated while sawing, but not the apparatus for lifting the boom or closing the tongs, which are needed during sawing for holding the logs L in place. Fluid flow to the LOADER--ROTATING PORTION is blocked when the valve 125 is actuated. Such selective use of the loader and the chain saw 22 is desirable because the capacity of the pump 124 may typically be insufficient for simultaneous operation of both saw and loader.

The restrictor block 128 has drilled passages interconnecting therein and arranged for connection to external conduit means for passing the main flow of hydraulic fluid therethrough to the reservoir 130 and back to the pump 124, for passing hydraulic fluid to and from the rod and blind ends respectively of the hydraulic cylinder 88, and vice-versa selectively, through a solenoid operated hydraulic valve 132 mounted on the restrictor block 128 when actuated, and for passing hydraulic fluid to a pressure gage 134 and a chain oiler conduit 136. When the spool of the valve 132 is in its unactuated, neutral position as shown in FIG. 3, all fluid flow to and from the cylinder 88 is blocked. The main flow of fluid back to the pump 124 from the motor 120 passes through a restriction 138 of the second conduit means 126, the restriction 138 preferably taking the form of a needle or other adjustable valve, thereby making the restriction 138 an adjustable one.

A third conduit means 140 is connected to the second conduit 126 between the motor 120 and the restriction 138 and passes through the spool of the solenoid valve 132 when the spool is in its actuated position for sawing engagement (shifted to the left from the normal, unactuated position shown in FIG. 3) to connect to the rod end of the cylinder 88, the blind end of the cylinder being connected by retraction flow conduit means 142 to the second conduit 126 between the restriction 138 and the pump 124 while the spool of the solenoid valve 132 is in actuated position for sawing engagement.

When pressurized hydraulic fluid flows through the motor 120, the main flow of the fluid back to the pump 124 is restricted by the restriction 138, causing a backpressure in the fluid flowing between the motor 120 and the restriction 138, while the fluid flowing beyond the restriction 138 toward the reservoir 130 and the pump 124 is essentially unpressurized. The magnitude of the backpressure is dependent on the rate of fluid flow through the restriction 138 and is thereby directly related to the speed of the positive displacement motor 120. Thus, when the valve 132 is first actuated leftward to put its spool in sawing engagement position (the chainsaw 22 normally having been in an upwardly pivoted, stationary, retracted position, not sawing wood, and both the motor 120 and the cylinder 88 having been locked stationary by the neutrally positioned spool of the valve 132 as explained hereinafter) the motor 120 will accelerate toward its normal free-running speed, and the fluid passing toward the restriction 138 will create a maximum backpressure so that fluid flowing through the third conduit means 140 to the rod end of the cylinder 88 will cause swift and powerful retraction of the piston rod 44, thereby swiftly and forcefully pivoting the chainsaw 22 downwardly into sawing engagement with the logs L.

Immediately upon establishment of sawing engagement, the motor 120 will be loaded down and slowed down under normal conditions of sawing forces required and power available, so that less hydraulic fluid will flow through the second conduit 126 and the backpressure available to the third conduit 140 will also drop. Thereupon, less force will be exerted by the rod end or forcing portion of the cylinder 88 for imparting relative movement between the chainsaw 22 and the log supports 24 and 26 for forcing the chainsaw 22 and the logs L supported on the supports 24 and 26 into sawing engagement. Thereafter, the chainsaw 22 will continue to saw through the logs L at intermediate speeds as determined by the parameters of pressure supplied, motor power rating, adjustment of the restriction 138, resistance of the logs L to sawing, and various other hydraulic and mechanical factors. However, if the chainsaw 22 slows as though to stall, the backpressure in the conduit means 140 will drop very low, as will the sawing engagement force, and the required sawing force will also drop and prevent stalling.

Therefore, as the resistance of the logs L to sawing varies, for whatever reason, such as rotten spots in the logs, knots in the logs, shifting of the logs causing binding, different log wood species, etc., the speed of the motor 120 will vary sometimes what and the magnitude of the backpressure transmitted through the third conduit 140 to the cylinder 88 will vary in some direct relation, thereby causing the motor 120 and the chainsaw 22 to operate at varying intermediate speeds generally corresponding to varying saw feeding or engagement force. Such operation in an automatically self-compensating mode makes the operator's job much less demanding of both skill and attention as well as assuring that the sawing proceeds at maximum sawing efficiency with the power available, with less downtime for clearing a stalled or jammed saw, and less chance of damage to the saw from stalling or jamming.

Upon sawing through a stack of logs L (or at any time during sawing), the spool of the solenoid valve 132 may be actuated to its saw retracting position (shifted to the right from its normal, unactuated position as illustrated in FIG. 3), and the motor 120, now at maximum speed under no load, will pass a maximum flow of oil through the restriction 138, thereby creating a maximum fluid backpressure magnitude for transmission through a portion of the third conduit 140 to and through the valve 132 from whence it is transmitted through a portion of the retraction flow conduit 142 to blind end or reversing portion of the cylinder 88 for imparting relative movement between the chainsaw 22 and the log supports 24 and 26 for disengaging the chainsaw 22 from the logs L.

The gage 134 is useful in adjusting the restriction 138 to obtain optimal predetermined magnitudes of fluid backpressure for fine tuning the apparatus to saw at maximum efficiency under various operating conditions, e.g., different hydraulic power supplies, dull saw teeth, cold oil, or whatever. An oiler conduit 136 has a needle valve 144 therein and is connected to an oil passage (not shown) in the lower portion of the guide bar 52 for providing an adjustable flow of oil to the lower reach 58 of the chain 56 before it starts into the logs L. The combined parallel check and needle valve units 146 placed in each of the conduits 140 and 142 adjacent the cylinder 88 provide conventional means for regulating the speed of movement of the chainsaw in its upward and downward motions. To prevent banging the saw 22 into sawing engagement with apparatus-damaging force, the needle valve in the conduit 142 must normally be set to control the downward engagement motion to a speed or feed which does not use the full capacity of the motor 120 when sawing relatively soft wood, such as pine or poplar logs.

The hydraulic power supply and utilization circuit as shown in FIGS. 2 and 3 is that commonly used with a knuckleboom loader (not shown) of the limited or non-continuous swing type where here is room only for an electrical control cable containing electrical conductors 150, 152, and 152' to be passed up through the column of the knuckleboom loader to a drum switch 154 as shown in FIG. 3, which may be placed at the operator's position on the swinging portion of the knuckleboom loader so that the operator can efficiently control both the sawing apparatus 20 and the loader from his position. The drum switch 154 has two sets of double-throw contacts, and is biased to its neutral position as shown in FIG. 3. It may be actuated rightwardly to energize the right-hand solenoid of the valve 132 to cause sawing engagement motion of the chainsaw 22, or leftwardly to energize the left-hand solenoid of the valve 32 to cause retraction motion of the chainsaw 22, through one set of contacts. In either actuated condition, the other set of contacts actuates the solenoid of the valve 125, thereby cutting off fluid from the rotating portion of the loader as aforesaid and sending fluid to the motor 120. When the switch 154 is in its neutral position, neither of the valves 125 nor 132 is actuated, the chainsaw 22 is deactivated, and the rotating portion of loader is supplied with fluid.

Alternatively, the hydraulic power unit 38 build on to the apparatus 20 may be used independently of the hydraulic power supply of the loader, or either the power unit 38 or the loader hydraulic power supply may be used to supply hydraulic power to both the apparatus 20 and the loader. Those skilled in the art will readily make the suitable hydraulic and electrical connections to the first and second conduit means 122 and 126 and the conductors 150,152, and 152' respectively at their uncoupled ends as indicated at the numeral 158 in FIG. 2.

Figure 5:
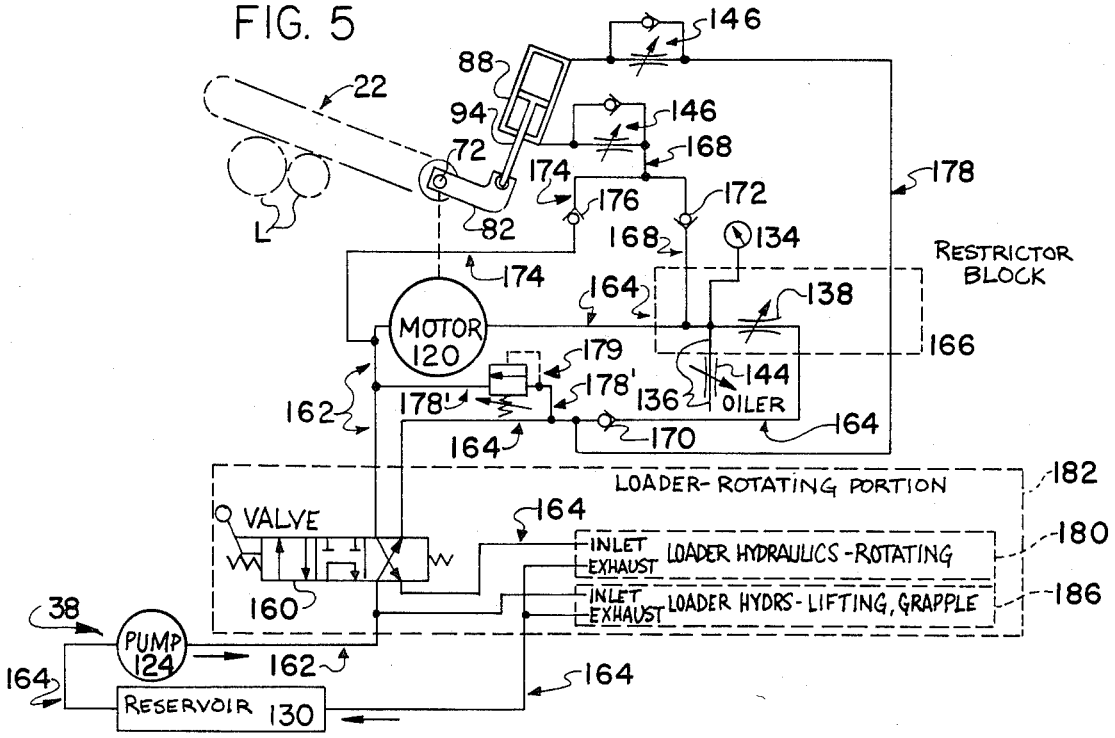
FIG. 5 is a schematic diagram of the hydraulic and mechanical apparatus shown in FIG. 4.

An alternative embodiment of the log sawing apparatus 20 of the present invention as shown in FIGS. 4 and 5 is mechanically the same as that of FIGS. 2 and 3, and only the hydraulic arrangements and circuitry are different. The reason for the difference is that this alternative embodiment is intended for use with a knuckleboom loader (not shown) of the "full-swing" or "unlimited rotation" type, where again the loader operator is located on the swinging portion of the loader and it is desirable that he should also control the log sawing apparatus 20 from his loader operating position. The columns of such full-swing loaders normally include twelve-port swivelling connections for passing hydraulic fluid to and from the swinging or rotating portion. The hydraulic power supply for such a loader may be located on the rotating portion of the loader as a counterbalance to the boom thereof (or alternatively, a separate supply such as the hydraulic power unit 38 shown in FIG. 1 may be used). Two conduits for hydraulically powering and controlling the sawing apparatus may be accommodated in the twelve-port swivelling connction, but not electrical conductors, so it is the object of this alternative embodiment of the present invention to provide both power and control for the sawing apparatus 20 through only two hydraulic conduits.

Referring to FIGS. 4 and 5, a hydraulic power unit 38 including a pump 124 and a reservoir 130 provides pressurized hydraulic fluid for operating a hydraulic motor 120 and a hydraulic cylinder 88 all as described hereinbefore for respectively operating a chainsaw 22 and impartment movement to the chainsaw 22 for sawing engagement and disengagement. Control of the chainsaw 22 for sawing operation as well as sawing engagement is provided by a manually operated four-way valve 160 located at the knuckleboom loader operator's position on the rotating portion of the loader. The spool of the valve 160 is biased to a neutral center bypassing position as shown in FIG. 5 where all fluid flow is blocked off from the pump 124 to the motor 120 and the cylinder 88.

Normal operation and engagement of the chainsaw 22 is provided when the valve 160 is manually operated to its saw engagement position (not as shown in FIG. 5, but with the spool of the valve 160 shifted to its rightmost position) where a first conduit means 162 including a passage through the valve 160 connects the pump 124 to the motor 120 for flow of pressurized hydraulic fluid thereto, and a second conduit means 164 including drilled passages through a restrictor block 166, another passage through the valve 160, passage through neutral center bypassing valves (not shown, but further explained hereinafter and similar to the valve 160) for the rotating motions of the loader, and the reservoir 130 connects the motor 120 back to the pump 124 for return flow of hydraulic fluid to the pump 124. In this saw operating mode, the operation is exactly like that described hereinbefore for the circuitry shown in FIG. 3 in that the flow of fluid between the motor 120 and the restriction 138 causes backpressure therebetween in the second conduit means 164, and a third conduit means 168 connected to the conduit means 164 therebetween is also connected to the rod end or forcing portion of the cylinder 88 for transmitting fluid thereto under the aforesaid backpressure for forcing the chainsaw 22 into sawing engagement with the logs. The magnitude of the backpressure is directly related to the speed of the motor 120 and chainsaw 22, so that the apparatus is again automatically self-compensating for the resistance to sawing just as explained hereinbefore in the description of the apparatus disclosed in FIGS. 2 and 3.

For retraction of the chainsaw 22 to its upwardly extending disengaged position upon manual actuation of the valve 160 to its saw retraction position (not hown in FIG. 5, but with its spool shifted to its leftmost position), the valve 160 thereby serving as means for causing a reversal of the previously described connections between the pump 124 and the motor 120 and the first and second conduit means 162 and 164 respectively, the following are provided: A first blocking means or check valve 170 located in the second conduit means 164 between the valve 160 and the restriction 138 for preventing reverse flow of fluid beyond the valve 170 toward or through the restriction 138 and the motor 120 after the aforesaid reversal of connections; a second blocking means or check valve 172 located in the third conduit means 168 for preventing reverse flow of fluid from the cylinder 88 to the conduit means 164 after the aforesaid reversal of connections; a fourth conduit means 174 connected to the first conduit means 162 between the valve 160 and themotor 120, extended to connect to the third conduit means 168 between the valve 172 and the cylinder 88, and having a third blocking means or check valve 176 therein for blocking fluid flow therethrough from the first conduit means 162 to the third conduit means 168; and a fifth conduit means 178 connected between the reversing portion or blind end of the cylinder 88 and a location on the second conduit means 164 between the valve 160 and the first check valve 170 for transmitting pressurized fluid from the pump 124 toward the blind end of the cylinder 88 after the aforesaid reversal of connections.

A sixth conduit means 178' is provided to connect the second conduit 164 (at a location therealong between the valves 160 and 170) to the first conduit 162 (at a location therealong between the valve 160 and the motor 120) for conducting the bulk of the fluid pumped after the aforesaid reversal of connections through the sixth conduit 178' back to the reservoir 130. An adjustable pressure relief valve 179 is included in the sixth conduit means 178' for regulating the pressure in the portion of the conduit 164 to which the conduit 178 is connected during the aforesaid reversal and for blocking backflow through the conduit 178' at other times, serving in general as an adjustable restriction and a check valve in the conduit 178'.

Thus, upon actuation of the valve 160, to its saw retraction position, pressurized fluid from the pump 124 flows to the valve 160 through a portion of the conduit means 162, passes through the valve 160 to the portion of the conduit means 164 located therebeyond and thence through the sixth conduit means 178', a portion of the conduit 162, the valve 160, and a portion of the conduit 164 to th reservoir 130, the pressure of the fluid being regulated as far as the relief valve 179 by the adjustable setting thereof. A portion of the thus-pressurized fluid is conducted by the fifth conduit means 178 toward the blind end or reversing portion of the cylinder 88, thereby causing the piston rod 94 to extend and pivot the chainsaw 22 upwardly to disengage it from the logs L. At the same time, the fluid forced from the rod end or forcing portion of the cylinder 88 passes through the portion of the third conduit means 168 adjacent the cylinder 88 to the connection with the fourth conduit means 174 for passage therethrough to the portion of the first conduit means 162 located between the motor 120 and the valve 160 and then passes through that portion of the conduit means 162 to the valve 160, through the valve 160 to the portion of the second conduit means 164 located between the valve 160 and the reservoir 130 and therethrough for exhaust to the reservoir 130.

Thus, disengaging movement is imparted to the chainsaw 22 upon the aforesaid reversal of connections and at the same time, flow of pressurized fluid to the motor 120 is blocked, thereby stopping the drive of the chainsaw 22. Complete operational control and powering of the chainsaw 22 is achieved with the simplicity of only two hydraulic hose or conduit connections between the chainsaw 22 and the operator's position on the knuckleboom loader.

Since there may not be sufficient hydraulic power available to simultaneously operate the chainsaw 22 and the hydraulically powered rotating motions (as indicated schematically at the numeral 180 in FIG. 5) of the rotating portion (as indicated schematically at the numeral 182 in FIG. 5) of the knuckleboom loader, the spool of the valve 160 in its centered, biased position as shown in FIG. 5 cuts off all fluid flow to the motor 120 and the cylinder 88 and bypasses the fluid from the pump 124 directly back to the portion of the second conduit means 164 located between the valve 160 and the reservoir 130. The just-aforesaid portion of the conduit 164 includes stacked valves (not shown, but included in the schematically shown rotating motions 180 which are included in the just-aforesaid portion of the conduit means 164) which are similar to the valve 160 and when in their centered conditions bypass fluid through the circuitry of the rotating motions 180 but in their actuated conditions utilize the fluid for operating the rotating motions 180. Thus the chainsaw 22 and the rotating motions 180 are selectively operable by use of the valve 160.

The hydraulically powered lifting and grappling motions (as indicated schematically at the numeral 186 in FIG. 5) of the rotating portion 182 of the knuckleboom loader should be available even during operating of the chainsaw 22 for clamping and holding the logs L steady during sawing, so the inlet and exhaust connections for the lifting and grappling motions 186 are made to the portions of the first and second conduit means 162 and 164 respectively located on the pump 124 and reservoir 130 side of the valve 160, the exhaust connection to the conduit 164 being made at a location thereon between the rotating motions 180 and the reservoir 130. In some cases, dual hydraulic pumps are used, one pump powering the chainsaw 22 and the rotating motions 180 and the other pump powering the lifting and grappling motions 186 only, in which case the motions 186 would be omitted from the circuitry of FIG. 5.

In a most preferred embodiment of the present invention for use with a a limited-swing loader, the hydraulic circuitry of FIG. 5 may be used by substituting a double solenoid, spring-centered valve of the same hydraulic configuration as the valve 160 therefor and controlling the just-aforesaid solenoid valve with a single set of double throw switches contacts similar to the set illustrated at the top of FIG. 3. Such an embodiment has the advantage that all sawing apparatus 20 could be constructed alike hydraulically so far as the chainsaw 22 operating apparatus is concerned, an expensive solenoid valve would be eliminated and also removed with its electrical connections from the restrictor block and its close proximity to the chainsaw 22.

While the restriction 138 has been disclosed as an adjustable needle valve, it might be practicable to use all or part of a second conduit means 126 or 164 as an equivalent restriction by suitable size selection.

Only a chainsaw 22 has been disclosed in the drawings, but a circular saw arrangement along the lines of prior art disclosures might employ the principles disclosed herein. Furthermore, the use of fluid pressure generated ahead of the restriction 138 has been disclosed as the means for forcing saw engagement while automatically compensating for changes in sawing resistance, but other hydraulic, mechanical, or electronic means could be used equivalently within the scope of the present invention, e.g., a spring or weight or constant fluid pressure could bias the saw into engagement while fluid under pressure having its magnitude inversely related to the saw speed acted in opposition to the spring or weight bias.

The particular embodiments disclosed in full detail herein and illustrated in the drawings have been provided for disclosure purposes only and are not intended to limit the scope of the present invention, which is to be determined by the scope of the appended claims.

I claim:

1. Power saw apparatus for sawing logs to length comprising a support for supporting logs for sawing, a power operated saw for sawing logs supported on said support, a hydraulic motor connected to said saw for driving thereof, hydraulically biased operating means for imparting relative movement between said saw and said support for forcing said saw and said logs into sawing engagement for sawing through said logs, and a hydraulic power circuit for supplying power to said motor and said means, said power circuit having a hydraulic pump and first conduit means connected to said pump and said motor for supplying hydraulic fluid under pressure to said hydraulic motor to flow therethrough for operation thereof to drive said saw, second conduit means conneted to said pump and said motor for return flow of said fluid from said motor to said pump, and means for causing hydraulic fluid to be supplied to said hydraulically biased operating means at pressures of magnitudes which are responsively related directly to the operational speed of said motor and inversely to the sawing forces generated by said saw against the resistance of the logs being sawed for causing said hydraulically biased operating means to impose a sawing engagement force between said saw and said logs directly related to the operational speed of said motor, said means for causing hydraulic fluid to be supplied to said hydraulically biased operating means comprises a restriction of said second conduit means between said motor and said pump for causing said pressures in said fluid in said second conduit means between said motor and said restriction during said return flow, and third conduit means connected to said hydraulically operating means and to said return flow second conduit means at a location therein for supplying a portion of said fluid under said pressures to said hydraulically operating means to said causing said hydraulically operating means to impose said sawing engagement force, whereby an increase in resistance of the logs to sawing causes a reduction in the saw operating speed which results in a decrease in the sawing engagement force and a decrease in the feed of the saw for sawing through said logs and thereby preventing stalling of said saw during said sawing engagement, and a drop in resistanace of said logs to sawing results in an increase in the saw operating speed and the sawing engagement force thereby causing an increase in the feed of the saw for sawing through the logs, the operating characteristics of said saw, motor, operating means, and power circuit being correlated for causing automatic compensation between said saw speed and said sawing engagement force for said preventing stalling during high resistance of the logs to sawing while causing said increase in the saw feed for greater sawing production during low resistance of the logs to sawing.

2. Power saw apparatus according to claim 1 and characterized further by means for stopping and drive of said saw and for reversing said hydraulically biased operating means to impart relative movement between said saw and said support for disengaging said saw and said logs, said hydraulically operating means having a forcing portion for causing said forcing movement upon supply of pressurized fluid to said forcing portion and a reversing portion for causing said disengaging movement upon supply of pressurized fluid to said reversing portion, said third conduit being connected to said forcing portion, said means for stopping and reversing comprising:

(a) means for causing reversal of the connections between said pump and said motor and said first and second conduit means for causing said hydraulic fluid under pressure to be supplied to said return flow second conduit means;

(b) means located in said reurn flow second conduit means for automatically blocking flow of pressurized fluid to said motor and said forcing means upon said reversal of said connections;

(c) means located in said third conduit means for automatically blocking back flow of fluid from said forcing means to said motor upon said reversal of said connections; and (d) means located in said return flow second conduit means between said reversal means and said means for automatically blocking flow of pressurized fluid to said forcing means for allowing flow of pressurized fluid to said reversing portion;

whereby said reversal of said supply and return flow connections automatically causes said stopping and reversing.

3. Power saw apparatus according to claim 1 and characterized further by means for stopping the drive of said saw and for reversing said hydraulically biased operating means to impart relative movement between said saw and said support for disengaging said saw and said logs, said hydraulically operating means having a forcing portion for causing said forcing movement upon supply of pressurized fluid to said forcing portion and a reversing portion for causing said disengaging movement upon supply of pressurized fluid to said reversing portion, said third conduit being connected to said forcing portion, said means for stopping and reversing comprising:

(a) means for causing reversal of the connections between said pump and said motor and said first and second conduit means for causing said hydraulic fluid under pressure to be supplied to said return flow second conduit means;

(b) first blocking means located in said return flow second conduit means between said reversal means and said restriction for blocking reverse flow of said hydraulic fluid under pressure beyond said blocking means toward said restriction and said motor;

(c) second blocking means located in said third conduit means for blocking reverse flow therthrough from said hydraulically operating means;

(d) fourth conduit means connected between said first conduit means and said third conduit means, said fourth conduit means being connected to said first conduit means at a location between said reversal means and said motor and to said third conduit means at a location between said second blocking means and said hydraulically operating means, and said fourth conduit means having third blocking means located therein for blocking flow therein from said first conduit means to said third conduit means; and (e) fifth conduit means connected between said reversing portion of said hydraulically operating means and a location on said second conduit means between said reversal means and said first blocking means for supplying pressurized fluid to said reversing portion upon said reversal of the connections between said pump and said motor and said first and second conduit means.

4. Power saw apparatus for sawing logs to length comprising a support for supporting logs for sawing, a power operated saw disposed for sawing logs supported on said support, a hydraulic motor connected to said saw for driving thereof, hydraulically biased operating means for imparting relative movement between said saw and said support for forcing said saw and said logs into sawing engagement for sawing through said logs, and a hydraulic power circuit for supplying power to said motor and said means, said power circuit having:

(a) a hydraulic pump and first conduit means connected to said pump and said motor for supplying hydraulic fluid under pressure to said hydraulic motor to flow therethrough for operation thereof to drive said saw;

(b) second conduit and reversing means for causing pressurized hydraulic fluid to be supplied to said hydraulically biased operating means for causing said operating means to impose a saw feeding force between said saw and said logs while driving said saw and, selectively, a reversing force for imparting relative movement between said saw and said support for disengaging said saw and said logs while stopping said fluid flow through said motor;

(c) and third conduit means connected to said pump, said motor, and said operating means for return flow of said fluid from said motor and said operating means to said pump;

said second conduit and reversing means for causing said operating means to selectively impose said reversing force while stopping said fluid flow comprising respectively:

(aa) a forcing portion for causing said saw feeding force and a reversing portion for causing said saw-disengaging, both included in said operating means;

(bb) reversal means for causing a reversal of the connections between said pump and said motor an operating means;

(cc) means for preventing flow of fluid under pressure of said motor and said forcing portion from said pump upon said reversal;

(dd) bypass means for supplying pressurized fluid to said reversing portion upon said reversal of connections; and (ee) means for exhausting fluid from said forcing means after said reversal;

whereby said reversal of connections automatically causes said disengaging and said fluid flow stopping.

5. Power saw apparatus according to claim 4 and characterized further in that said means (cc) comprises a check valve, said means (dd) comprises conduit, and said means (ee) comprises a conduit having a check valve therein permitting fluid flow therethrough in the direction of said exhausting only.

6. Power saw apparatus according to claim 1 and characterized further in that said restriction is adjustable to adjust the relation of said pressures and the operational pressure to said hydraulic motor.

* * * * *